US011021348B2

(12) United States Patent
Zimmer et al.

(10) Patent No.: US 11,021,348 B2
(45) Date of Patent: Jun. 1, 2021

(54) AUTOMATED CARGO TRANSFER SYSTEM

(71) Applicants: Trent Zimmer, Houma, LA (US); Matthew Rigdon, Houston, TX (US)

(72) Inventors: Trent Zimmer, Houma, LA (US); Matthew Rigdon, Houston, TX (US)

( * ) Notice: Subject to any disclaimer, the term of this patent is extended or adjusted under 35 U.S.C. 154(b) by 0 days.

(21) Appl. No.: 16/547,140

(22) Filed: Aug. 21, 2019

(65) Prior Publication Data

US 2020/0062556 A1 Feb. 27, 2020

Related U.S. Application Data

(60) Provisional application No. 62/720,994, filed on Aug. 22, 2018.

(51) Int. Cl.
*B66C 13/06* (2006.01)
*B66C 13/48* (2006.01)
(Continued)

(52) U.S. Cl.
CPC ..... *B66C 13/06* (2013.01); *B63B 27/10* (2013.01); *B66C 13/08* (2013.01); *B66C 13/48* (2013.01); *B66C 2700/08* (2013.01)

(58) Field of Classification Search
CPC ..... B63B 27/36; B63B 27/00; B63B 27/30; B63B 25/004; B63B 25/22; B63B 25/002;
(Continued)

(56) References Cited

U.S. PATENT DOCUMENTS 2,539,201 A * 1/1951 Pasko ..... B60P 1/649 410/80
3,109,677 A * 11/1963 Hoover, Sr. ..... B66C 1/66 294/110.1
(Continued)

FOREIGN PATENT DOCUMENTS

KR 101258924 B1 4/2013
WO 2006/016851 A1 2/2006

*Primary Examiner* — Gregory W Adams
(74) *Attorney, Agent, or Firm* — F. Wayne Thompson, Jr.; Asgaard Patent Servcices, LLC

(57) ABSTRACT

An automated cargo transfer system is used, in conjunction with a crane, to load cargo onto, and unload cargo from, the deck of a watercraft. An example automated cargo transfer system comprises: a dynamic positioning system installed on the watercraft; a crane hook system installed on the crane; a crane automation system configured to automate the operation of the crane; and a load plan comprising: data that identifies all cargo being transported by the watercraft, data used by the dynamic positioning system to actively position and orient the watercraft during loading and unloading of the watercraft, and data used by the crane hook system to actively position and orient it's hook mechanism during loading and unloading of the watercraft. The automated cargo transfer system is configured to actively track the location of the watercraft, the hook mechanism of the crane hook system, and cargo. The automated cargo transfer system is also configured to actively position and orient the watercraft and the hook mechanism of the crane hook system based on the location and weight of cargo being loaded onto, and unloaded from, the watercraft.

4 Claims, 8 Drawing Sheets

(51) Int. Cl.
*B63B 27/10* (2006.01)
*B66C 13/08* (2006.01)

(58) Field of Classification Search
CPC ..... B63B 23/58; B63B 23/18; B63B 23/28; B65G 63/004; B63C 7/16
See application file for complete search history.

(56) References Cited

U.S. PATENT DOCUMENTS 3,172,371 A * 3/1965 Gutridge ..... B61D 45/007 410/79
3,428,356 A * 2/1969 Anderson ..... B66C 1/66 294/110.1
3,945,674 A * 3/1976 Ide ..... B66C 1/10 294/67.1
4,003,472 A * 1/1977 Reynolds ..... B66C 13/02 212/274
4,179,233 A * 12/1979 Bromell ..... B66C 13/02 212/272
4,324,385 A * 4/1982 Cojean ..... B63B 27/16 254/270
4,547,857 A * 10/1985 Alexander ..... B66D 1/525 212/308
4,932,541 A * 6/1990 Belsterling ..... B66C 13/02 212/271
5,102,288 A * 4/1992 Kawasaka ..... A41H 15/00 269/54.5
6,109,199 A * 8/2000 Wallach ..... B63B 27/36 114/254
6,511,270 B1 * 1/2003 Burke ..... B60P 7/0807 410/101
6,964,552 B1 * 11/2005 Krabbendam ..... B63B 27/10 414/137.1
7,648,183 B2 * 1/2010 Cornwell ..... B66C 1/62 294/90
8,087,369 B2 * 1/2012 Foce ..... B63B 35/00 114/44
9,434,068 B2 * 9/2016 Frisk ..... B25J 9/10
9,527,560 B2 * 12/2016 Khachaturian ..... B66C 13/02
2008/0107505 A1 5/2008 McCown et al.
2011/0076130 A1 * 3/2011 Stocker ..... B66C 19/002 414/815
2012/0089320 A1 4/2012 Tan et al.
2012/0255478 A1 * 10/2012 Hadeler ..... F03D 13/22 114/61.31
2016/0068373 A1 * 3/2016 Chin ..... B63B 27/10 414/138.1

* cited by examiner

AUTOMATED CARGO TRANSFER SYSTEM

CROSS REFERENCE TO RELATED APPLICATION

This application claims the benefit of U.S. Provisional Application Ser. No. 62/720,994, which was filed on Aug. 22, 2018, the entirety of which is incorporated herein by reference.

TECHNICAL FIELD

This disclosure relates to implementations of an automated cargo transfer system.

BACKGROUND

Loading and offloading a supply vessel (e.g., an ocean-going ship) using existing equipment is time consuming and extremely hazardous, particular during periods of rough weather. Working on the deck of a supply vessel is one of the most dangerous work environments for crew members. Therefore, there is a need to eliminate crew members, or at least reduce the number of crew member, on deck while a supply vessel is being loaded and/or offloaded.

Further, cargo handling technology typically used to load and offload supply vessels relies on multiple workers/crew to individually move each unit of cargo. This is a labor-intensive task that is both time consuming and expensive. Therefore, there is a need to reduce the amount of labor required to load and offload cargo from a supply vessel.

Accordingly, it can be seen that needs exist for the automated cargo transfer system disclosed herein. It is to the provision of an automated cargo transfer system configured to address these needs, and others, that the present invention is primarily directed.

SUMMARY OF THE INVENTION

Implementations of an automated cargo transfer system are provided. The automated cargo transfer system is used, in conjunction with a crane, to load cargo onto, and unload cargo from, the deck of a watercraft.

An example automated cargo transfer system comprises: a dynamic positioning system installed on the watercraft, the dynamic positioning system is configured to position and orient the watercraft when actuated; a crane hook system installed on the crane, the crane hook system comprises a hook mechanism configured to interface with cargo; a crane automation system configured to automate the operation of the crane, the crane in conjunction with the crane hook system are used to load cargo onto, and unload cargo from, the deck of the watercraft at the direction of the automated cargo transfer system; and a load plan comprising: data that identifies all cargo being transported by the watercraft, data used by the dynamic positioning system to actively position and orient the watercraft during loading and unloading of the watercraft, and data used by the crane hook system to actively position and orient the hook mechanism during loading and unloading of the watercraft. The automated cargo transfer system is configured to actively track the location of the watercraft, the hook mechanism of the crane hook system, and cargo. The automated cargo transfer system is also configured to actively position and orient the watercraft and the hook mechanism of the crane hook system based on the location and weight of cargo being loaded onto, and unloaded from, the deck of the watercraft.

BRIEF DESCRIPTION OF THE DRAWINGS

Like reference numerals refer to corresponding parts throughout the several views of the drawings.

DETAILED DESCRIPTION

Figure 1:
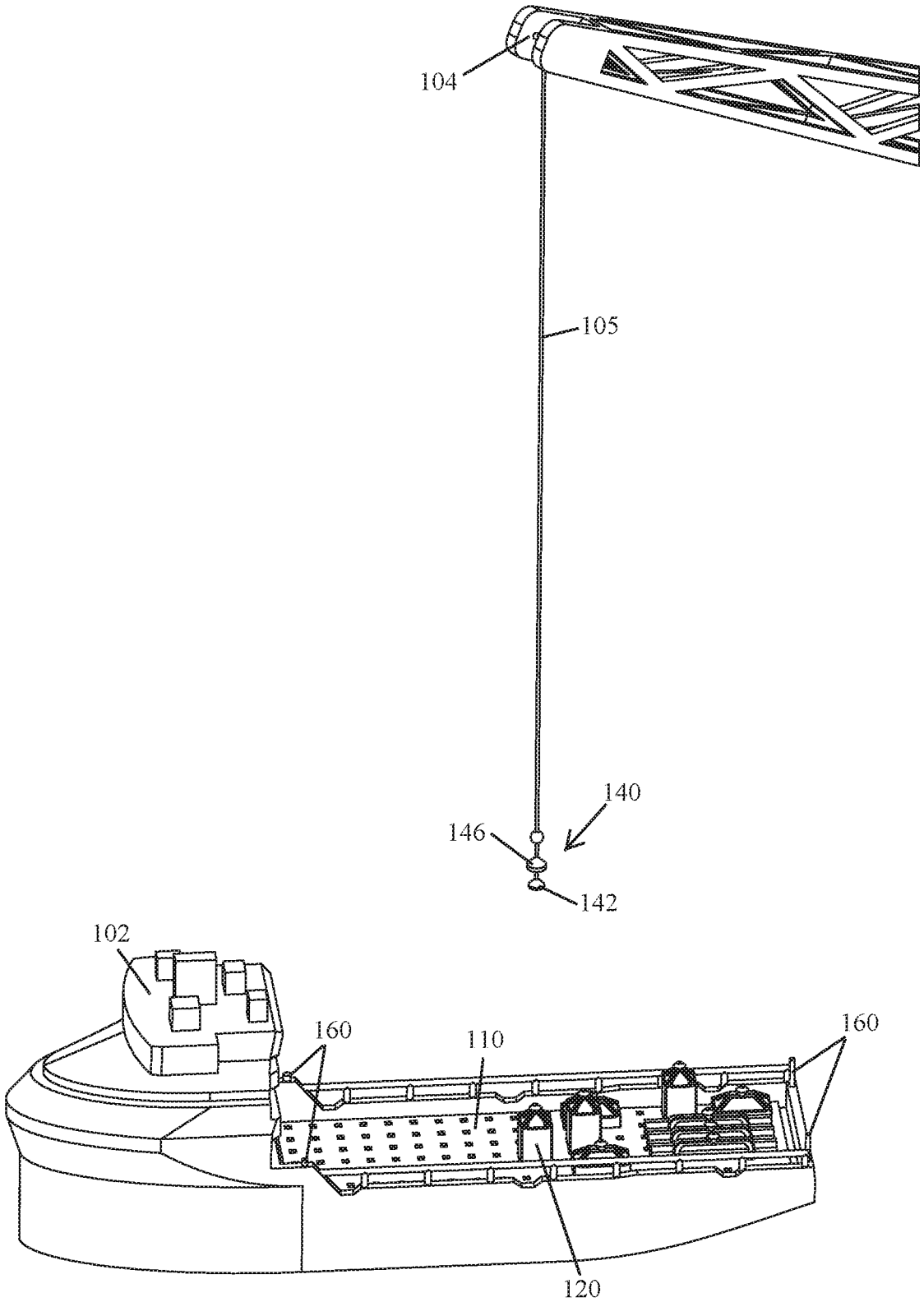
FIGS. 1-4 illustrate an example automated cargo transfer system according to the principles of the present disclosure.

FIGS. 1-4 illustrate an example implementation of an automated cargo transfer system 100 according to the principles of the present disclosure. The automated cargo transfer system 100 may be used to load cargo onto, and unload cargo from, the deck of a ship 102.

Modern ships 102 frequently use dynamic positioning systems to hold station near an offshore asset (e.g., an oil and/or gas platform). Implementations of the automated cargo transfer system 100 are configured for use with such a vessel 102 and can be used to load cargo onto, and unload cargo from, the deck thereof. In this way, the crew's exposure to danger while cargo is being unloaded onto the offshore asset, and/or cargo from the offshore asset is being loaded onto the vessel 102, is minimized.

As shown in FIGS. 1-4, in some implementations, the automated cargo transfer system 100 may comprise: a deck section 110 that includes an array of sockets 112 therein; at least one cargo lifting device 120 comprised of a base portion 122 and a crane coupling 130; a crane hook system 140 configured to interface with the crane coupling 130 and thereby used to reposition a cargo lifting device 120, and its cargo; and a crane automation system 150 configured to operate a crane 104 equipped with the crane hook system 140 and thereby load cargo onto, or unload cargo from, a deck section 110 of the system 100; or a suitable combination thereof.

Figure 3:
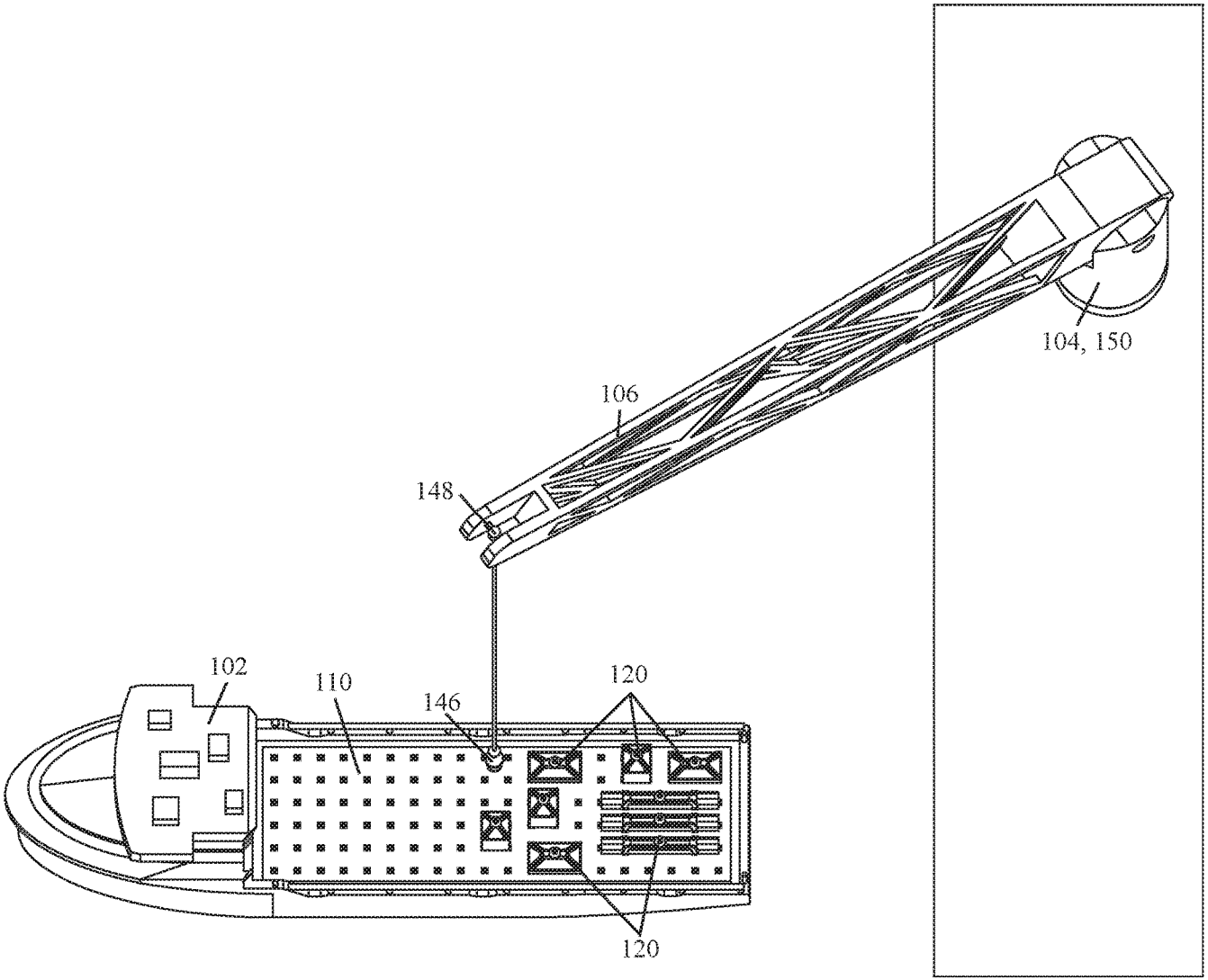
Figure 4:
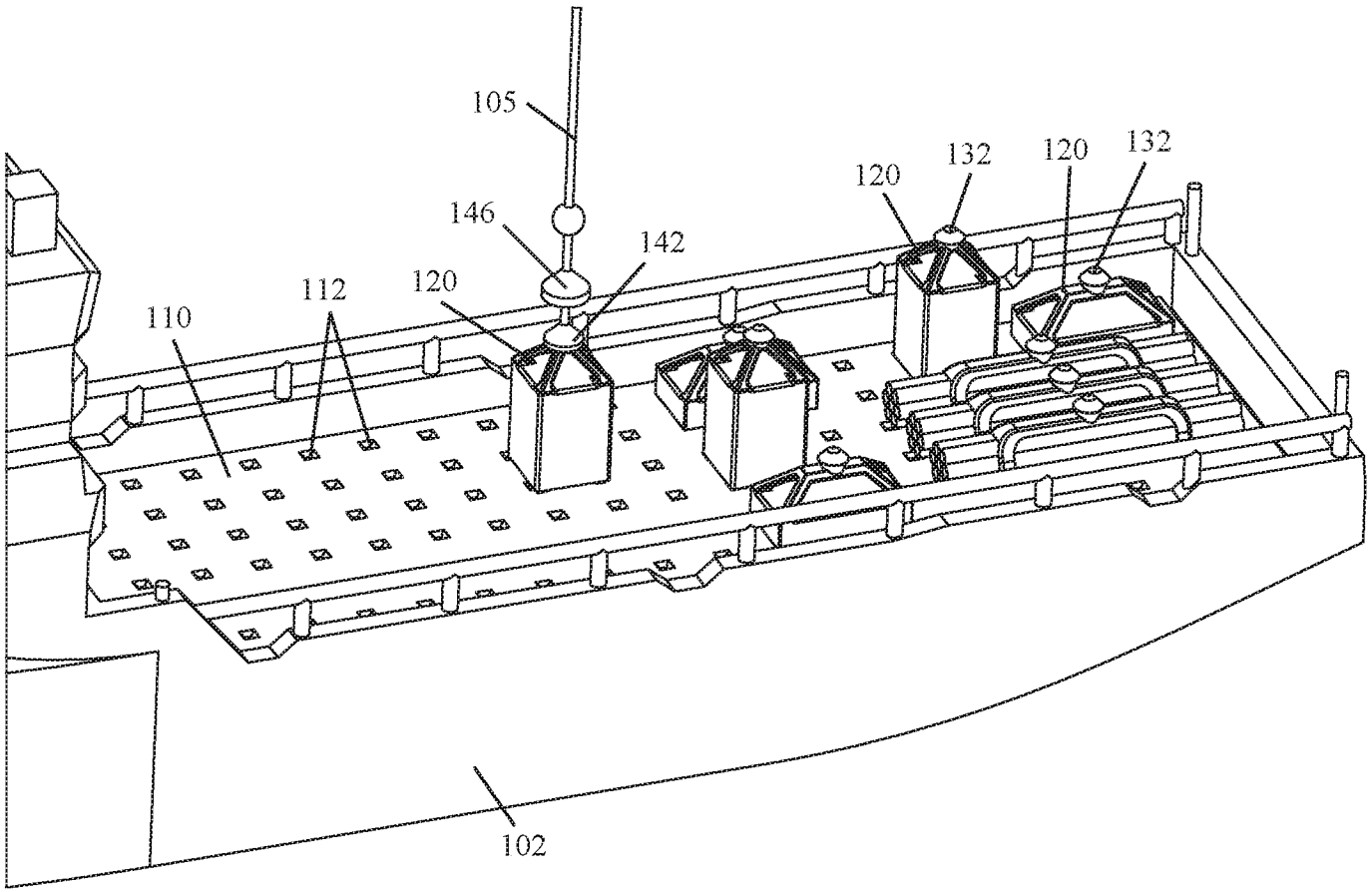

A shown in FIGS. 3 and 4, in some implementations, the deck section 110 of an automated cargo transfer system 100 is installed on, or retrofit to, the deck of a ship 102 (e.g., an offshore supply vessel) and configured to removably secure one or more cargo lifting devices 120 thereon. In some implementations, a ship 102 may include more than one deck section 110. In some implementations, a deck section 110 may be configured to record the relative position and weight of cargo positioned thereon, this data may be used to complete stability calculations for the ship 102.

Figure 7:
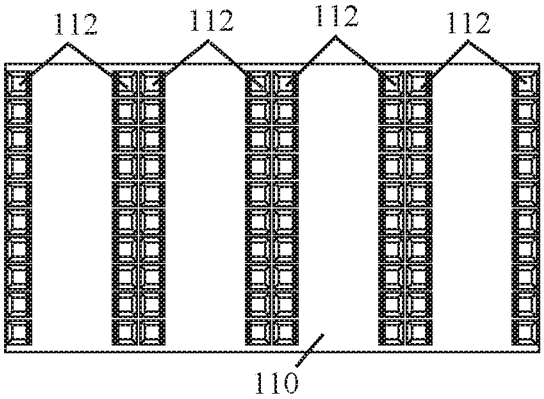
FIGS. 7 and 8 illustrate an example deck section of the automated cargo transfer system shown in FIGS. 1-4.
Figure 8:
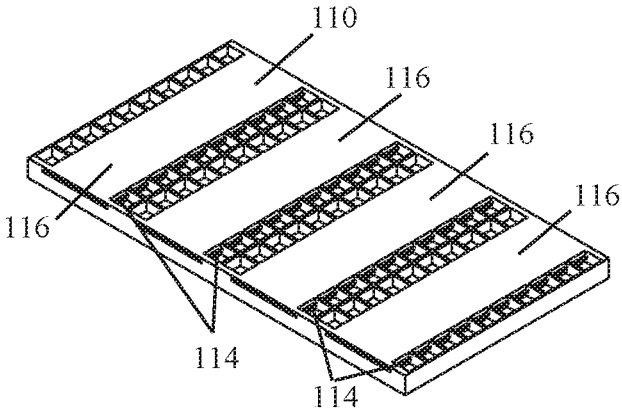

As shown in FIGS. 7 and 8, in some implementations, a deck section 110 comprises an array of sockets 112, each socket 112 includes a mechanical locking mechanism 114 and is configured to receive a foot 124 of a base portion 122 therein. In some implementations, the sockets 112 of a deck section 110 may be spaced apart from each other in a grid-like array, or matrix. The mechanical locking mechanism 114 of each socket 112 interfaces with a foot 124 of the base portion 122, thereby securing the cargo lifting device 120 in place. In some implementations, the mechanical locking mechanism 114 may be a sectional lock, or another suitable mechanical locking mechanism known to one of ordinary skill in the art (e.g., pegs). In some implementations, an electromechanical locking mechanism may be used in conjunction with, or in-lieu of, a mechanical locking mechanism 114 to secure the foot 124 of a base portion 122 within a socket 112 of a deck section 110. One of ordinary skill in the art, having the benefit of the present disclosure, would be able to select an appropriate electrotechnical locking mechanism.

In some implementations, one or more sensors configured to record the weight, and relative position, of a cargo lifting device 120 and its cargo may be positioned within each socket 112 of a deck section 110. In this way, the automated cargo transfer system 100 may record the weight, and track the relative position, of all cargo positioned on a deck section 110 of the ship 102. This data (i.e., weight and the relative position of cargo) may be used to complete stability calculations for the ship 102.

As shown in FIG. 8, in some implementations, a deck section 110 may further comprise one or more electromagnetic locking mechanisms 116 that are positioned amongst, or in-between, the sockets 112. Each electromagnetic locking mechanism 116 may be positioned and configured to secure a cargo lifting device 120 in position on the deck section 110 by magnetically adhering to the underside of the base portion 122. In some implementations, one or more electromagnetic locking mechanisms 116 may be used instead of mechanical locking mechanisms 114 to secure one or more cargo lifting devices 120 in position on a deck section 110 of an automated cargo transfer system 100.

Although not shown, in some implementations, a deck section 110 of an automated cargo transfer system 100 may not include any sockets 110 therein. One or more electromagnetic locking mechanisms 116 may be used to secure a cargo lifting device in position on the deck section 110.

As shown in FIG. 4, in some implementations, each cargo lifting device 120 may be used to reposition (e.g., lift, lower, and horizontally move) a cargo. In some implementations, the base portion 122 and/or the crane coupling 130 of a cargo lifting device 120 may be retrofitted to a cargo (e.g., an intermodal container, a lifting basket, a tote tank, a pipe rack, or other suitable shipping container).

Figure 5:
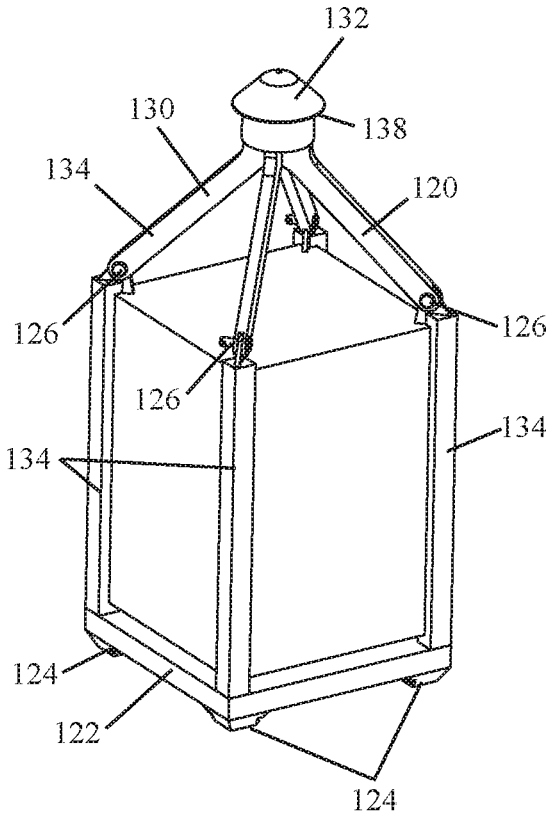
FIG. 5 illustrates an example cargo lifting device of the automated cargo transfer system shown in FIGS. 1-4, wherein the cargo lifting device is shown secured to a cargo.
Figure 6:
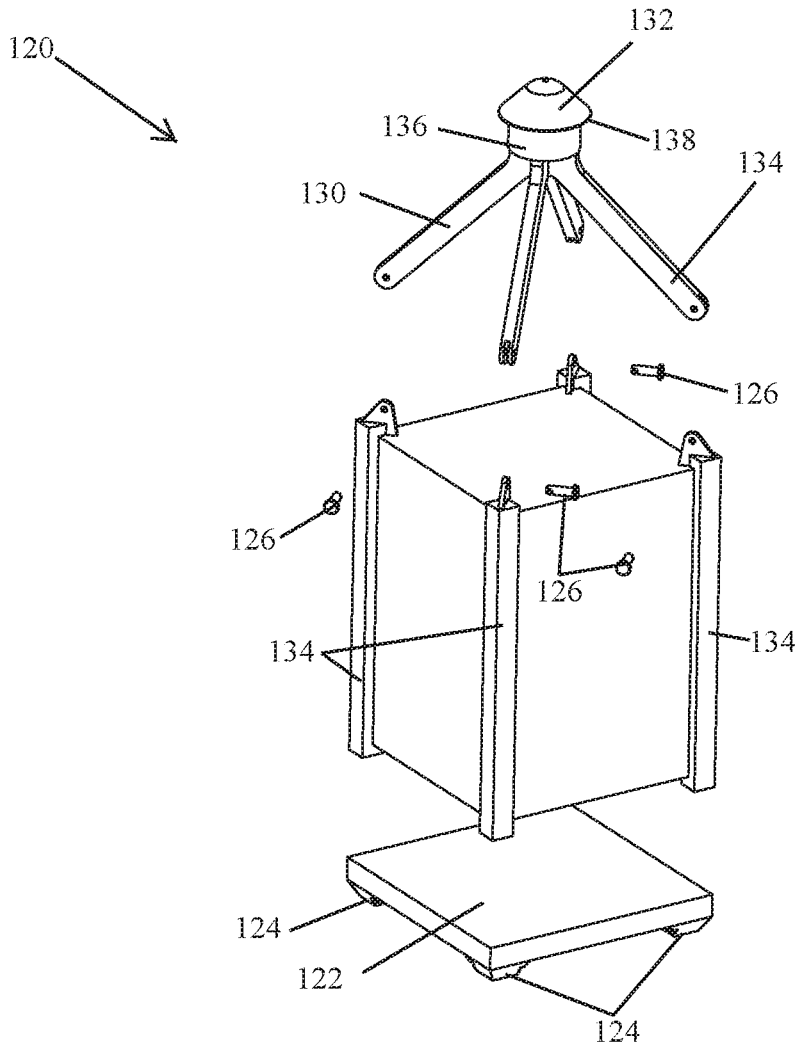
FIG. 6 illustrates an exploded view of the cargo lifting device shown in FIG. 5.

As shown in FIGS. 5 and 6, in some implementations, the base portion 122 of a cargo lifting device 120 is configured to support the weight of a cargo placed thereon and to interface with a portion (e.g., one or more sockets 112) of the deck section 110. In this way, the primary and/or secondary locking mechanisms (e.g., 114, 116) may be used to secure the cargo lifting device 120 in place on the deck section 110.

As shown in FIG. 5, in some implementations, a base portion 122 of a cargo lifting device 120 may include four or more feet 124 on the underside thereof, each foot 124 is configured (e.g., positioned and dimensioned) to be received within a socket 112 of a deck section 110. In some implementations, there may be less than four feet 124 on the underside of the base portion 122. In some implementations, the base portion 122 of a cargo lifting device 120 may be configured (e.g., dimensioned) to maximize deck space by not overlapping sockets 112 that it is not intended to interface with.

In implementations where the deck section 110 does not include sockets 112 therein, the base portion 122 of the cargo lifting device 120 may not include feet 124 on the underside thereof.

As shown in FIG. 4, in some implementations, the crane coupling 130, in conjunction with a crane 104 equipped with the crane hook system 140, may be used to lift, lower, and horizontally move a cargo lifting device 120, and its attendant cargo. In some implementations, the crane coupling 130 of a cargo lifting device 120 may be secured, directly or indirectly, to the base portion 122 and thereby used to lift a cargo resting thereon (see, e.g., FIG. 5).

As shown in FIGS. 5 and 6, in some implementations, a crane coupling 130 of a cargo lifting device 120 may comprise a self-centering lift cone 132 that is configured to interface with the crane hook system 140; and mounting hardware 134 that can be used to secure the crane coupling 130 directly to the base portion 122 or, in some instances, a cargo.

As shown in FIGS. 5 and 6, in some implementations, the self-centering lift cone 132 of the cargo lifting device 120 may include an annular lip 138 that is larger in diameter than the central body portion 136 of the crane coupling 130. In this way, a portion of the crane hook system 140 may engage with the underside of the annular lip 138 and thereby lift the cargo lifting device 120 and its attendant cargo.

In general, the mounting hardware 134 of a cargo lifting device 120 may be any suitable part, or combination of parts, needed to facilitate attachment of the lift cone 132, by the central body portion 136 of the crane coupling 130, to the base portion 122, or a cargo (see, e.g., FIGS. 5 and 6). In some implementations, pins 126, or other suitable mechanical fasteners, may be used to removably secure the mounting hardware 134 to a base portion 122 of a cargo lifting device 120 or, in some instances, a cargo. In some implementations, one or more portions of the mounting hardware 134 may be welded to the base portion 122 of a cargo lifting device 120, or in some instances, a cargo.

In some implementations, a cargo lifting device 120 may also include a sensor that is affixed thereon, or directly to the cargo. This sensor is a unique identifier for the cargo and may be configured to track, for example, movement of the cargo, temperature of the cargo, weight of the cargo, cargo type (e.g., hazardous material(s), etc.), pressure within the cargo vessel, or a combination thereof.

As shown in FIGS. 3 and 4, in some implementations, the crane hook system 140 of the automated cargo transfer system 100 may comprise a conical hook mechanism 142 that is configured to axially rotate about the crane cable 105 its attached to; and one or more sensor suites 146, 148 that collect and provide data to the crane automation system 150.

In some implementations, the conical hook mechanism 142 of the crane hook system 140 is configured to directly interface with the self-centering lift cone 132 of a crane coupling 130. In this way, the conical hook mechanism 142 may be used to move a cargo lifting device 120, and its attendant cargo. In some implementations, the conical hook mechanism 142 is a shell that is configured to receive at least a portion of a self-centering lift cone 132 therein; and includes a locking mechanism (e.g., a camming lock mechanism) that is configured to engage with the underside of the annular lip 138 found on the self-centering lift cone 132. Operation of the locking mechanism may be automated, thereby allowing the crane automation system 150 to connect and/or disconnect the conical hook mechanism 142 to/from the self-centering lift cone 132 of a cargo lifting device 120.

In some implementations, the sensor suite(s) 146, 148 of the crane hook system 140 may comprise one or more sensors/input devices (e.g., a camera, lidar, a laser range finder, etc.) that feed data to the crane automation system 150 and/or an operator.

As shown in FIG. 4, in some implementations, a sensor suite 146 of the system 100 may be positioned on the crane cable 105, a fixed distance above the conical hook mechanism 142. In this way, data collected by one or more sensors of the sensor suite 146 can be related to the actual position of the conical hook mechanism 142. In some implementation, the one or more sensors/input devices of the cable sensor suite 146 may be configured to, for example, detect vessel movement, locate and identify cargo, communicate with the computer system of the crane 104, or a combination thereof.

As shown in FIG. 3, in some implementations, another sensor suite 148 of the system 100 may be positioned at, or near, the end of a crane's 104 boom 106. In some implementations, the one or more sensors/input devices of the boom's 106 sensor suite 148 may be configured to, for example, detect vessel location, detect the location of the hook mechanism 142, detect the identity of cargo, or a combination thereof.

In some implementations, the computer system of the crane 104 may be configured to control all aspects of its operation. In some implementations, the computer system of the crane 104 may be configured to move and/or rotate the conical hook mechanism 142 in order to: compensate for overswing, heave, and/or vessel movement, and to position a cargo loading device 120 so that it is properly oriented to interface with a deck section 110 of the system 100. Further, the computer system of the crane 104 may be configured to interface with other portions of the automated cargo transfer system 100 (e.g., the crane automation system 150, the computer system of the vessel 102, etc.).

In some implementations, the crane automation system 150 of the automated cargo transfer system 100 may be configured to perform the following task:

The crane automation system 150 may be configured to automate the operation of a crane 104 equipped with the crane hook system 140. In this way, without the assistance of the crew, cargo loading devices 120 and attendant cargo may be loaded onto, or unloaded from, a deck section 110 of a supply vessel 102 equipped with the system 100.

Further, the crane automation system 150, using the sensor suite(s) 146, 148, may be configured to locate cargo positioned on a deck section 110 of the system 100, secure the conical hook mechanism 142 to the crane coupling 130 of a cargo lifting device 120, and reposition the cargo lifting device 120, and its attendant cargo, on the deck section 110 of a vessel 102 and/or unload it from the supply vessel 102.

Further still, the crane automation system 150, using the sensor suite(s) 146, 148, may be configured to load cargo onto a deck section 110 of the system 110 by using the conical hook mechanism 142 to lift a cargo lifting device 120, its attendant cargo, and position it on a portion of the deck section 110 of the system 110.

In some implementations, the crane automation system 150 uses the sensor suite(s) 146, 148 to, for example, detect/track vessel 102 movement, locate specific cargo loading devices 120, orient (or register) the conical hook mechanism 142 so that it is positioned to interface with the crane coupling 130 of a cargo lifting device 120, position a cargo lifting device 120 being carried by the crane 104 so that the feet 124 located on the base portion 122 thereof are received by the appropriate sockets 112 in the deck section 110, or a suitable combination thereof.

In some implementations, the computer system of a vessel 102 equipped with an automated cargo transfer system 100 may be used to interface the components of the system 100 (e.g., any locking mechanism(s) 114, 116, a crane 104 equipped with a crane hook system 140, the crane automation system 150, location beacons 160, etc.) with the dynamic positioning system of the vessel 102, one or more systems of an offshore asset, one or more systems of an onshore loading facility, or a suitable combination thereof.

The following is an example scenario in which an automated cargo transfer system 100 may be used. The following scenario is an example only and is not meant to limit the scope of the automated cargo transfer system 100 invention.

Initially, the loadout requested by an offshore asset (e.g., an oil rig) is planned. The loadout may comprise a variety of cargo that is to be transported to the offshore asset by a supply vessel 102.

Figure 2:
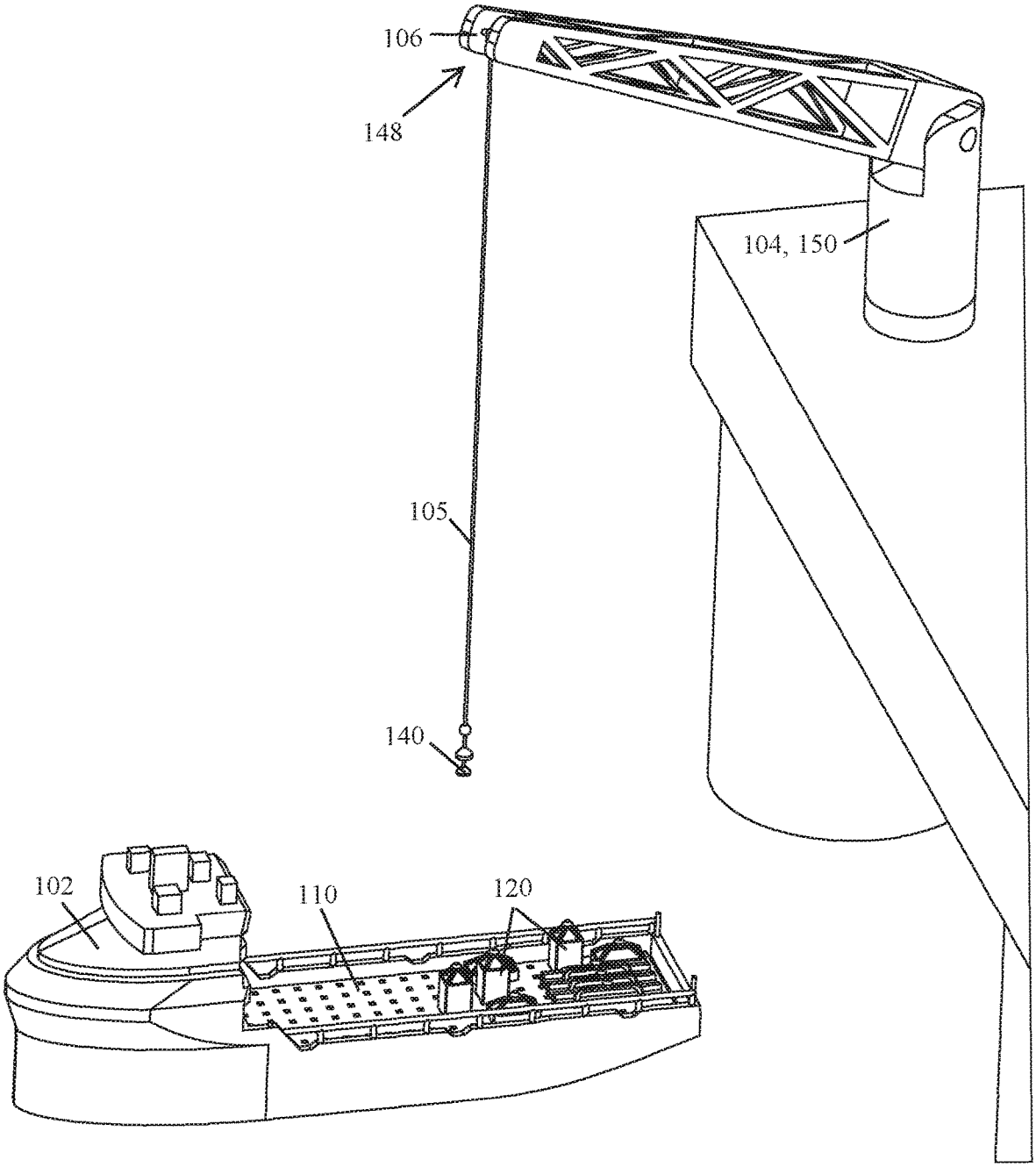

Then, the loadout request is transmitted to the onshore loading facility which may use a legacy crane, or a crane 104 equipped with the crane hook system 140 that is operated by the crane automation system 150, to load cargo onto a supply vessel 102 equipped with at least one deck section 110 of the system 100 (see, e.g., FIGS. 2 and 3). If a legacy crane is used to load cargo onto the deck section(s) 110 of the supply vessel 102, shoreside personal could be used to assist with positioning cargo loading devices 120 so that the feet 124 thereof interface with the sockets 112 of a deck section 110. In some implementations, as the crane 104 lifts a cargo lifting device 120 and its attendant cargo, a weight detecting sensor of the cable sensor suite 146 may be used to detect the weight of the cargo as it is loaded onto the supply vessel 102. The recorded weight of the cargo may be associated with the sensor affixed to the cargo loading device 120, or directly to the cargo, that serves as its unique identifier.

Figure 9:
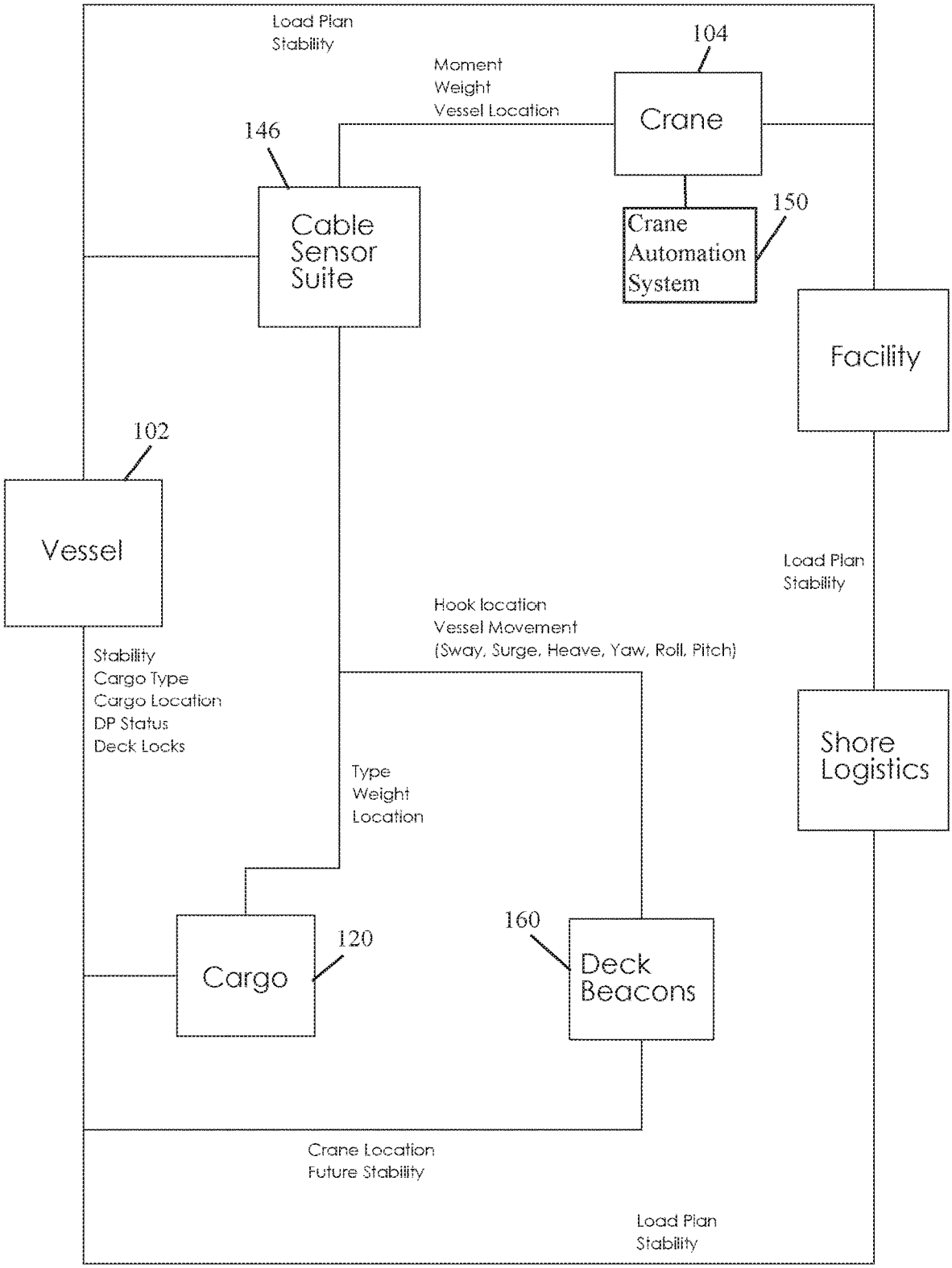
FIG. 9 illustrates the automated cargo transfer system as a multi-directional flow chart.

Next, at the direction of the offshore asset, the requested cargo is loaded onto the supply vessel 102 using the automated cargo transfer system 100. To initiate the requested cargo being loaded onto the supply vessel 102, the offshore asset would communicate with the computer system of the supply vessel 102 and thereby activate the supply vessel's 102 dynamic positioning system and verify that the requested cargo will not create an unsafe stability issue for the supply vessel 102 (see, e.g., FIG. 9).

Then, the supply vessel 102 travels to the offshore asset and establishes itself in a proper location, suitable for unloading cargo, near the offshore asset.

Next, the offshore asset will initiate a discharge plan in which a crane 104 equipped with a crane hook system 140 will be used to unload cargo from the deck section(s) 110 of the supply vessel 102 onto a desired location of the offshore asset. Each cargo loading device 120, and its attendant cargo, will be unloaded in a specified order that will be completed based on vessel stability, crane 104 load limitations, and any required cargo unloading sequence that was included as part of the discharge plan.

Then, using the sensor suite(s) 146, 148 of the system 100 to scan the deck section(s) 110 and identify cargo that is part of the loadout request, the crane 104 at the direction of the crane automation system 150 will begin to unload identified cargo from the supply vessel 102. The crane 104, in conjunction with the crane automation system 150, is configured to compensate for the unintended movement of the supply vessel 102 and thereby adjust the movements of the conical hook mechanism 142 so that it can interface with the self-centering lift cone 132 of the desired cargo lifting device 120. Further, in some implementations, the supply vessel 102 may also include one or more location beacons 160 thereon that are configured to precisely track the movement of the supply vessel 102 and communicate that data to the crane automation system 150 (see, e.g., FIGS. 1 and 9).

Once the conical hook mechanism 142 of the crane hook system 140 is secured to the crane coupling 130 of a cargo lifting device 120, the locking mechanism(s) 114, 116 securing the feet 124 of the base portion 122 within the sockets 112 of the deck section 110 will be released. In this way, the crane 104 is able to lift the cargo loading device 120, and its attendant cargo, off the deck section 110 of the supply vessel 102 and transfer it to the offshore asset.

This process continues until all cargo lifting devices 120, and attendant cargo, identified as part of the requested loadout are unloaded from the supply vessel 102.

While the above operations are described in a particular order, this should not be understood as requiring that such operations be performed in that particular order, or that all operations be performed, to achieve desirable results.

In some implementations, the release of any locking mechanism(s) (e.g., 114, 116) holding a particular cargo lifting device 120 in position on the supply vessel 102 may be simultaneous, or follow a staged process. As an example, a staged process may comprise the mechanical locking mechanism(s) 114 being released from engagement with a cargo lifting device 120 prior to any electromagnetic locking mechanism(s) 116. In some implementations, when cargo is being transported between the onshore loading facility and the offshore asset, any mechanical locking mechanism(s) 114 of a system 100 may be used to secure one or more cargo lifting devices 120 in position on the deck section(s) 110 of the supply vessel 102. In general, it is envisioned that any electromagnetic locking mechanism(s) 116 of a system 100 will primarily be used when cargo is initially loaded onto, or just prior to cargo being unloaded from, the deck section(s) 110 of the vessel 102, while the mechanical locking mechanism(s) are not being used (i.e., disengaged from the cargo loading device(s) 120).

In some implementations, the method or methods described above in connection with the automated cargo transfer system 100, the crane automation system 150 in particular, may be executed or carried out by a computing system including a tangible computer-readable storage medium, also described herein as a storage machine, that holds machine-readable instructions executable by a logic machine (i.e. a processor or programmable control device) to provide, implement, perform, and/or enact the above described methods, processes and/or tasks. When such methods and processes are implemented, the state of the storage machine may be changed to hold different data. For example, the storage machine may include memory devices such as various hard disk drives, CD, or DVD devices. The logic machine may execute machine-readable instructions via one or more physical information and/or logic processing devices. For example, the logic machine may be configured to execute instructions to perform tasks for a computer program. The logic machine may include one or more processors to execute the machine-readable instructions. The computing system may include a display subsystem to display a graphical user interface (GUI) or any visual element of the methods or processes described above. For example, the display subsystem, storage machine, and logic machine may be integrated such that the above method may be executed while visual elements of the disclosed system and/or method are displayed on a display screen for user consumption. The computing system may include an input subsystem that receives user input. The input subsystem may be configured to connect to and receive input from devices such as a mouse, keyboard, or gaming controller. For example, a user input may indicate a request that a certain task is to be executed by the computing system, such as requesting the computing system to display any of the above described information, or requesting that the user input updates or modifies existing stored information for processing. A communication subsystem may allow the methods described above to be executed or provided over a computer network. For example, the communication subsystem may be configured to enable the computing system to communicate with a plurality of personal computing devices. The communication subsystem may include wired and/or wireless communication devices to facilitate networked communication. The described methods or processes may be executed, provided, or implemented for a user or one or more computing devices via a computer-program product such as an application programming interface (API).

In another example implementation of the automated cargo transfer system, the crane hook system may be configured to facilitate the transfer of fluid cargo (e.g., liquids, gases, and/or solids). In some implementations, a crane hook system configured to facilitate the transfer of fluid cargo may be similar to the crane hook system 140 discussed above but includes a hose and a hose connector junction configured to interface with the discharge manifold found on a fluid containing cargo, instead of a conical hook mechanism 142. In some implementations, such a crane hook system may include one or more sensors that are configured to detect the location of a discharge manifold on a cargo, detect if the hose connector junction is locked to the discharge manifold, and/or detect the movement of fluids. In some implementations, the crane automation system 150 may be configured to automate the positioning and engagement of the hose connector junction with the discharge manifold of a cargo.

Implementations of the crane hook system that are configured to facilitate the transfer of fluid cargo may also include a pumping mechanism configured to facilitate the movement of a fluid through the hose and/or an automated shutdown mechanism that activates if a fluid leak is detected.

In some implementations, the automated cargo transfer system 100 may further comprise an onboard crane that is secured to the supply vessel 102 (not shown). The onboard crane may be equipped with a crane hook system 140. The onboard crane can be used when the primary crane 104 is unable to effectively reach all portions of the deck section 110 and/or to further consolidate one or more cargo lifting devices 120, and their attendant cargo, on the deck section 110 of the supply vessel 102. In some implementations, the onboard crane includes a crane automation system configured to operate the onboard crane. The crane automation system of the onboard crane may be the same as, or similar to, the crane automation system 150 described above.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. An automated cargo transfer system used, in conjunction with a crane, to load cargo onto, and unload cargo from, a deck of a watercraft, the automated cargo transfer system comprising:

a dynamic positioning system installed on the watercraft, the dynamic positioning system is configured to position and orient the watercraft when actuated;

a crane hook system installed on the crane, the crane hook system comprises a hook mechanism configured to interface with cargo;

a crane automation system configured to automate the operation of the crane, the crane in conjunction with the crane hook system are used to load cargo onto, and unload cargo from, the deck of the watercraft at the direction of the automated cargo transfer system; and a load plan comprising: data that identifies all cargo being transported by the watercraft, data used by the dynamic positioning system to actively position and orient the watercraft during loading and unloading of the watercraft, and data used by the crane hook system to actively position and orient the hook mechanism during loading and unloading of the watercraft;

wherein the automated cargo transfer system is configured to actively track the location of the watercraft, the hook mechanism of the crane hook system, and cargo;

wherein the automated cargo transfer system is configured to actively position and orient the watercraft and the hook mechanism of the crane hook system based on the location and weight of cargo being loaded onto, and unloaded from, the deck of the watercraft.

2. The automated cargo transfer system of claim 1, wherein the hook mechanism is configured to axially rotate about a crane cable.

3. The automated cargo transfer system of claim 1, wherein the deck is configured to record the relative position and weight of cargo positioned thereon, this data is used to complete stability calculations for the watercraft.

4. The automated cargo transfer system of claim 1, wherein the crane hook system further comprises one or more sensor suites that collect and provide data, used to facilitate the transfer of cargo, to the load plan.

* * * * *